United States Patent [19]

Kawamura et al.

[11] Patent Number: 4,880,174

[45] Date of Patent: Nov. 14, 1989

[54] PACKAGE SUPPORT APPARATUS FOR AUTOMATIC WINDER

[75] Inventors: Shuzo Kawamura, Joyo; Yukio Hirai, Ohtsu, both of Japan

[73] Assignee: Murata Kikai Kabushiki Kaisha, Kyoto, Japan

[21] Appl. No.: 216,846

[22] Filed: Jul. 8, 1988

[30] Foreign Application Priority Data

Jul. 10, 1987 [JP] Japan ..... 62-172352

[51] Int. Cl.[4] ..... B65H 49/26; B65H 54/42; B65H 54/553

[52] U.S. Cl. ..... 242/18 DD; 242/129.51

[58] Field of Search ..... 242/18 DD, 129.51, 68.4

[56] References Cited

U.S. PATENT DOCUMENTS

| | | | |
|---|---|---|---|
| 3,131,885 | 5/1964 | Furst et al. | 242/129.51 |
| 3,552,666 | 1/1971 | Stenmans | 242/18 DD |
| 3,941,320 | 3/1976 | Strunk | 242/18 DD |
| 4,013,242 | 3/1977 | Burysek et al. | 242/129.51 |
| 4,126,279 | 11/1978 | Munnekehoff | 242/18 DD |
| 4,572,449 | 2/1986 | Naylor | 242/18 DD |

*Primary Examiner*—Stanley N. Gilreath

*Attorney, Agent, or Firm*—Spensley Horn Jubas & Lubitz

[57] ABSTRACT

In a textile machine, in which a package is arranged to abut against a rotating drum for rotation for winding up a yarn on a surface of a take-up tube of the package and a brake device is provided in a take-up tube support portion for braking the rotation of the take-up tube in relation with stopage of the rotary drum, there is provided a package support device which comprises an opening/closing arm supporting the brake device and rockably connected to a cradle base of a cradle arm; and a lock mechanism provided between the opening/closing arm and the cradle base for regulating the rocking movement of the opening/closing arm.

18 Claims, 5 Drawing Sheets

PACKAGE SUPPORT APPARATUS FOR AUTOMATIC WINDER

FIELD OF THE INVENTION

This invention relates to a package support apparatus of a textile machine for winding a yarn into a package of desired shape.

RELATED ART STATEMENT

In high speed operation of the automatic winder, there is a problem that the yarn on the package surface might be damaged if the rotation of the package is stopped solely by the frictional force of the rotary drum when the drive of the drum is stopped due to yarn breakage or the like. Therefore, the applicant invented and filed a patent application (Japanese Patent Application No. 62-100486, filed on Apr. 23, 1987 and published on Nov. 4, 1988 as Japanese Patent Laid Open No. 63-267670) concerning a method and an apparatus for independently braking the package rotation in relation with a stop of the rotary drum drive. This brake device is provided at the tip end of one of the cradle arms of the construction which grip the package through the use of spring force.

If the braking force is increased to stop the package rotation quickly in response to the stop of the rotary drum drive, the reaction force of the brake becomes greater and the cradle arm with the brake device is pulled away from the package against the spring action in the case of the prior art in which the braking force and the package gripping spring force act in the same direction, instabilizing the package support and in some cases causing the package to fall off the cradle arms.

Object and Summary of the Invention

It is an object of the present invention to provide an improved package support device which includes a brake device for braking a package which is in high speed rotation, permitting to stop quickly the package.

According to an embodiment of the present invention, in a textile machine, in which a package is arranged to abut against a rotating drum for rotation for winding up a yarn on a surface of a take-up tube of the package and a brake device is provided in a take-up tube support portion for breaking the rotation of the take-up tube in relation with stopage of the rotary drum, there is provided a package support device which comprises an opening/closing arm supporting the brake device and rockably connected to a cradle base of a cradle arm; and a lock mechanism provided between the opening/-closing arm for regulating the rocking movement of the opening/closing arm.

BRIEF DESCRIPTION OF THE DRAWINGS

The drawings illustrate preferred embodiments of the invention, in which.

DETAILED DESCRIPTION OF PREFERRED EMBODIMENTS

Preferred embodiments of the package support apparatus for automatic winder according to the present invention are now described with reference to the drawings. The package support apparatus of the present invention, however, can be also applied to other textile machines such as false twisting machine, a twisting frame, a spinning frame and etc. for supporting packages at a winding-up portion thereof.

The apparatus according to an embodiment of the invention has a feature in the construction of a cradle arm 2, and is substantially same as the conventional automatic winder in other respects. Therefore, illustration and detailed description of the automatic winder as a whole are omitted.

Figure 1:
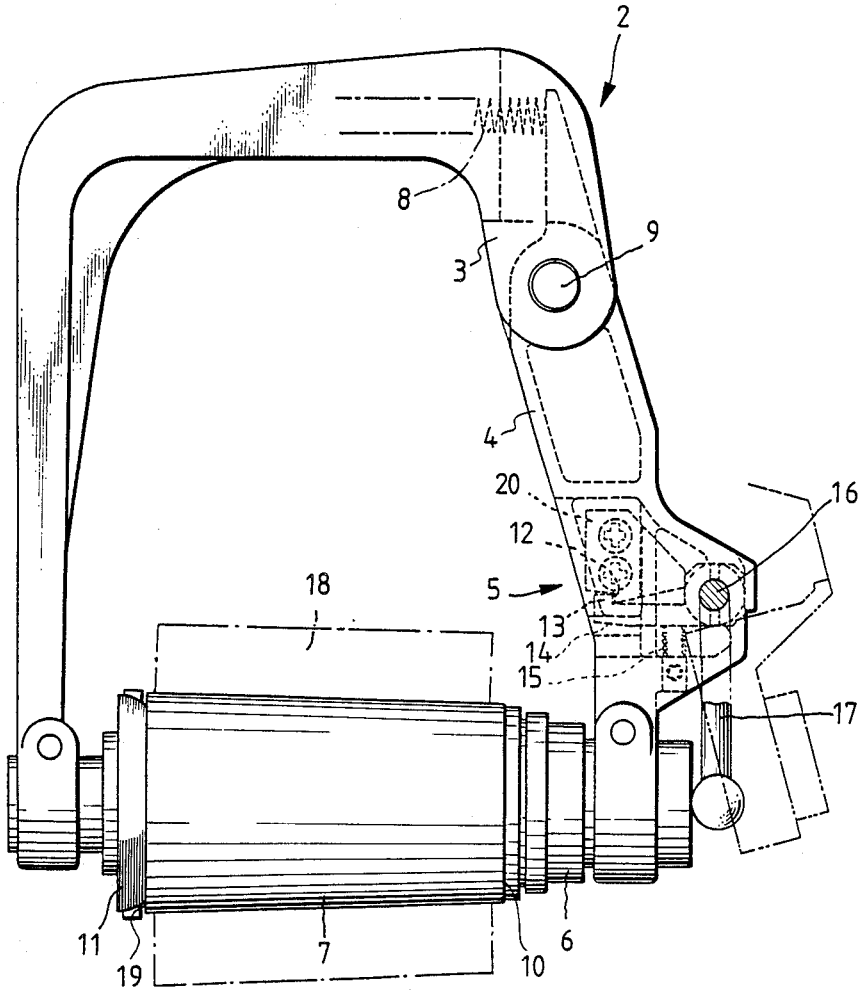
FIG. 1 is a plan view of a first embodiment.
Figure 2:
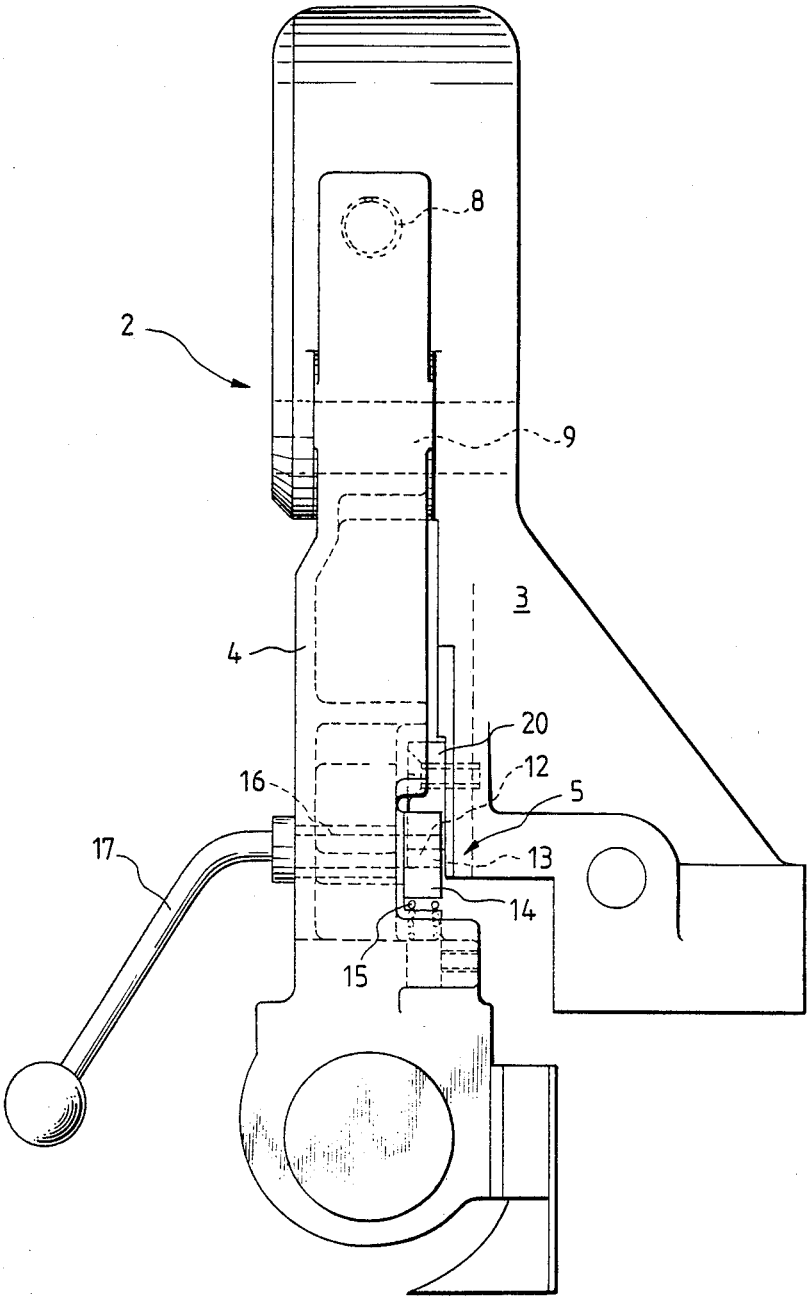
FIG. 2 is a right-hand side view of the same embodiment.

Illustrated in FIGS. 1 and 2 is a first embodiment, in which the cradle arm 2 is constituted by a cradle base 3, an opening/closing arm 4, and a lock mechanism 5 provided between the cradle base 3 and the opening/-closing arm 4 which supports a brake device 6. Similarly to the conventional apparatus, the opening/closing arm 4 is pivotally supported on the cradle base 3 for rocking movement, and its rocking movement about a support shaft 9 is suppressed by the resilient force of a spring 8. One open end 10 of a take-up tube 7 like a paper tube is closed by the brake device 6, gripping the take-up tube 7 in cooperation with a support member 11 which supports the other end 19 in the same manner as in the conventional apparatus.

The brake device 6 presses the take-up tube 7 leftward in FIG. 1 to brake the rotation of the take-up tube 7 by the frictional force in the same manner as in the conventional device, so that detailed description in this regard is omitted here.

The rocking movement of the opening/closing arm 4 about the support shaft 9 is regulated by the lock mechanism 5 which is provided between the arm 4 and the cradle base 3. This lock mechanism 5 includes: a plate-like member 20 securely fixed to the cradle base 3 and having a pawl 12; a locking arm 14 formed with a hook portion 13 at the fore end thereof and rotatably supported on the opening/closing arm 4; and a coil spring 15 for pressing the locking arm 14, interlocking the hook portion 13 with the pawl 12 to inhibit rocking movement of the opening/closing arm 4 when the winding tube 7 is in gripped state. The shaft 16 which serves as the center of the rocking movement of the locking arm 14 has a handle 17 connected thereto, so that the shaft 16 can be rotated by turning the handle 17 about the shaft 16 to turn the locking arm 14 against the action of the spring 15, disengaging the hook portion 13 from the pawl 12 to cancel the locked state of the lock mechanism 5.

Figure 3:
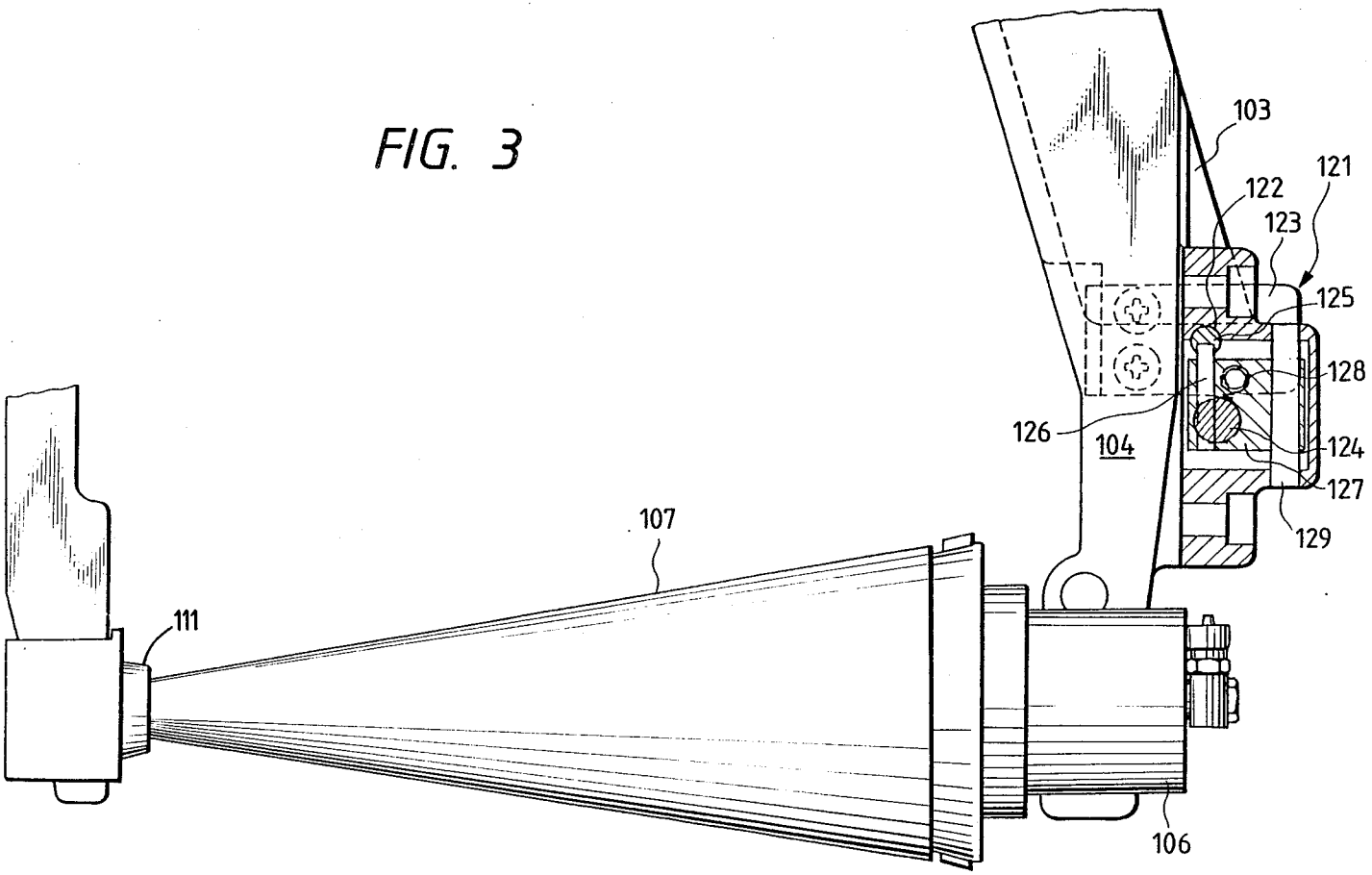
FIG. 3 is a plan view of a second embodiment.
Figure 4:
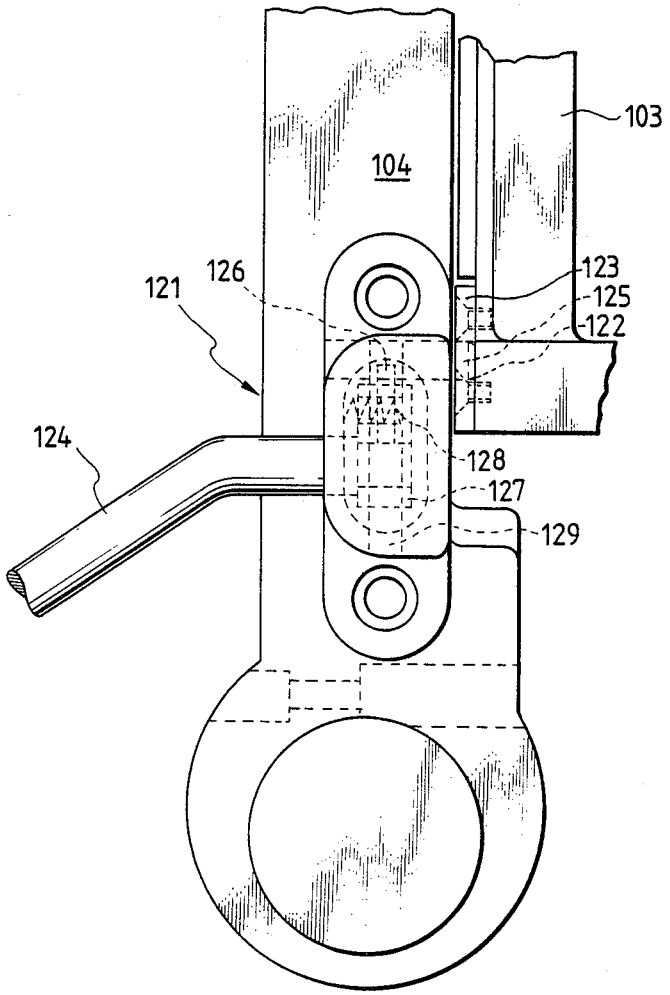
FIG. 4 is a right-hand side view of the same embodiment.

Illustrated in FIGS. 3 and 4 is a second embodiment of the invention, which is different from the foregoing first embodiment in the construction of the lock mechanism 5.

An opening/closing arm 104 supports a brake device 106 and is pivotally supported on a cradle base 103. The brake device 106 grips a take-up tube 107 in cooperation with a support member 111 therebetween.

Figure 5:
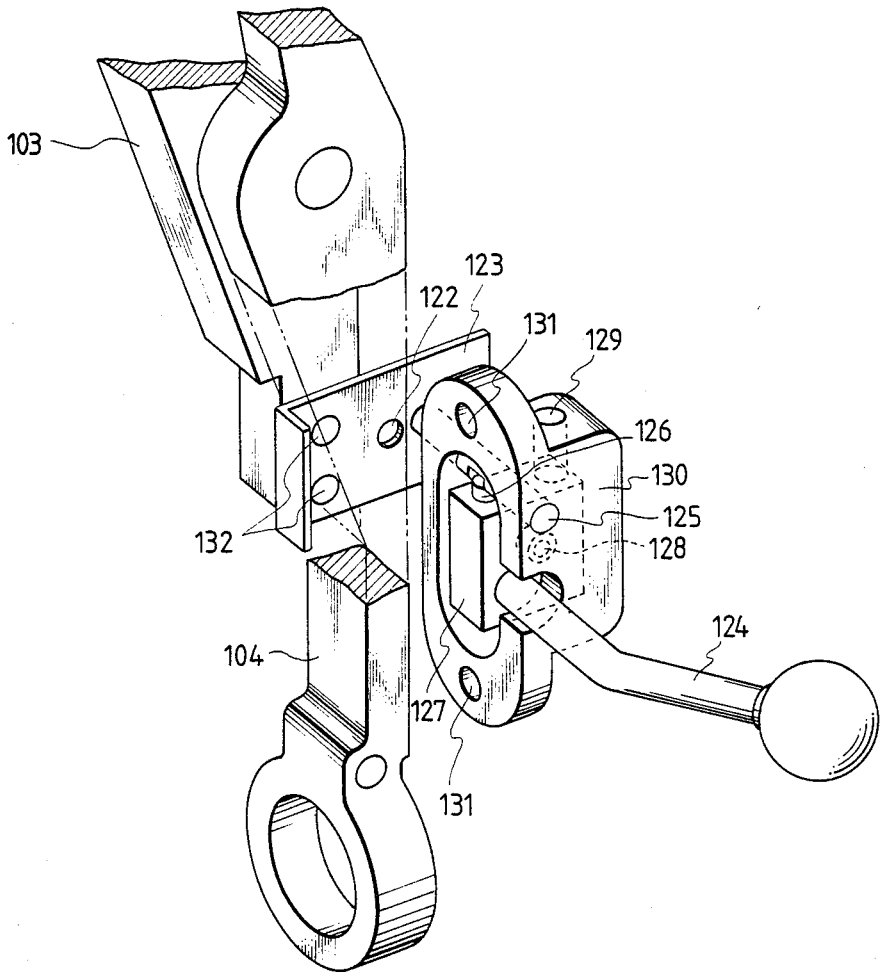
FIG. 5 is a perspective exploded view showing elemental portion of the second embodiment.

The lock mechanism 121 in the second embodiment includes, a plate-like member 123 fixedly secured to the cradle base 103 and provided with a locking hole 122, and a rod member 125 provided on the opening/closing arm 104 and movable back and forth by rotation of the handle 124. The locked state is established when the rod 125 is moved forward until its fore end portion engages in the locking hole 122 in the plate-like member 123, and the locked state is cancelled when the rod 125 is retracted until its fore end portions comes out of the locking hole 122. A link shaft 126 is fixed to the rod 125 in a direction perpendicular to the center axis of the latter, the link shaft 126 being integrally secured to a block 127 which is fixed to a base portion of the handle 124. The block 127 is slidably supported by a shaft 129 at one end portion thereof. A coil spring 128 which is abutted against the block 127 at the side thereof urges the latter in the direction of the plate-like member 123 in FIG. 4, thereby constantly biasing the rod 15 to engage the locking hole 122 of the plate-like member 123. The block 127 is arranged to slide leftward in FIG. 4 against the action of the coil spring 128 when the handle 124 is turned retracting the rod 125 from the locking hole 122 upon rotation of the handle 124 to release the cradle base 103 and the opening/closing arm 104 from the locked state. FIG. 5 is a perspective exploded view for further illustrating the second embodiment of the lock mechanism 121. The block 127 is disposed within an inner space formed in the bracket 130 in the manner that the block 127 is capable of turning slightly around the shaft 129. The bracket 130 is secured to the opening/-closing arm 104 by inserting a bolt into a hole 131. A hole 132 is provided on the plate-like member 123 to fix the platelike member 123 to the cradle base 103 by inserting a bolt therethrough.

Now, the operation of the apparatus of the invention is described by way of the first embodiment shown in FIGS. 1 and 2.

In order to doff a package 18 which has been formed on the surface of the take-up tube 7, the handle 17 is turned about the shaft 16 counterclockwise in the drawing. At this time, the shaft 16 is turned together with the handle 17, turning counterclockwise the locking arm 14 which is fixed to the shaft 16 and moving the hook portion 13 away from the pawl portion 12 to release same from the locked state. If in this state the opening/-closing arm 4 is turned counterclockwise about the shaft 9, the brake device 6 is moved away from the open end 10 of the winding tube 7, and the package 18 can be removed from the cradle arm 2. Then, one end of a fresh take-up tube 7 is inserted into the support member 11, and the opening/closing arm 4 is turned clockwise in the drawing to push the brake device 6 into the open end 10, returning the handle 17 into the position shown in FIG. 1. Whereupon, the hook portion 13 of the locking arm 14 is interlocked with the pawl portion 12, the opening/closing arm 4 is locked to the cradle base 3 to retain the take-up tube 7 in position, permitting to wind a yarn on the surface of the take-up tube 7.

If the rotary drum, not shown, is stopped due to a yarn breakage during the winding operation, the brake 6 is actuated to press the open end 10 of the winding tube 7 strongly. At this time, higher the rotational speed of the package 18, stronger becomes the reaction force of the braking force, acting to pull the take-up tube 7 away from the brake device 6 in the rightward direction in the drawing. However, the hook portion 13 of the locking arm 14 is interlocked with the pawl portion 12 to prevent rocking movements of the opening/closing arm 6, while preventing the brake device 6 from being extracted from the open end of the take-up tube 7 by the reaction force.

In the apparatus of the present invention, the opening/closing arm which supports the brake device is rockably supported on the cradle base, and the lock mechanism is provided between the opening/closing arm and the cradle base. Therefore, in the locked state, there is no possibility of the package falling off the cradle arm even if a strong braking force applied to the package which is in higher speed rotation, permitting to stop quickly a package in high speed rotation at the time of yarn breakage and thus contibuting to enhance the production efficiency all the more.

What is claimed is:

1. In a textile machine for winding yarn about a take-up tube of a package, the textile machine having a brake device for braking the rotation of said take-up tube, a package support device comprising:

a cradle base;

an opening/closing arm supporting the brake device and rockably connected to the cradle base; and a lock mechanism provided between the opening/-closing arm and the cradle base for regulating the rocking movement of the opening/closing arm.

2. The package support device as claimed in claim 1, wherein said lock mechanism comprises:

a plate-like member securely fixed to the cradle base and having a pawl, a locking arm having an end provided with a hook portion and being rotatably supported on the opening/closing arm, the hook portion being positioned to interlock with the pawl of the plate-like member, a coil spring for pressing the hook portion of the locking arm toward the pawl, and a handle connected to the locking arm and being turnable about a shaft in a direction to disengage the hook portion from the pawl to cancel the locked state of the lock mechanism.

3. The package support device as claimed in claim 1, wherein said lock mechanism comprises:

a plate-like member fixedly secured to the cradle base and provided with a locking hole, a rod member provided on the opening/closing arm and movable back and forth, said rod being movable to engage the locking hole, and a handle which is connected to the rod, the handle being movable in a turning motion to move the rod according to the turning motion.

4. The package support device as claimed in claim 3, further comprising:

a link shaft connecting the rod member with the handle, a spring, a shaft, and a block secured with the link shaft and the handle, the block being slidably supported by the shaft and being urged by the spring to bias the rod to engage with the locking hole of the plate-like member.

5. A package supporting device for rotatably supporting a package in a textile machine, the device comprising:

a first package support arm;

a second package support arm movable, with respect to the first package support arm, between a package supporting position and a package releasing position;

a movement inhibiting lock disposed on the second package support arm and arranged to inhibit movement of the second package support arm from the package supporting position to the package releasing position; and a lock release device operatively connected with the movement inhibiting lock.

6. A package supporting device as claimed in claim 5, further comprising:

a first member being substantially stationary with respect to the first package support arm, the first member having a hook receiving portion; and wherein the movement inhibiting lock comprises a second member disposed on the second package support arm, the second member having a hook portion arranged to selectively engage the hook receiving portion of the first member.

7. A package supporting device as claimed in claim 6, wherein the lock release device comprises disengagement means for selectively disengaging the hook portion and the hook receiving portion.

8. A package supporting device as claimed in claim 6, wherein the lock release device comprises:

a movable handle movable in a first direction; and a linkage connecting the movable handle and the second member, the linkage being arranged to transmit movement of the handle in the first direction to movement of the hook portion away from the hook receiving portion.

9. A package support device as claimed in claim 6, wherein the movement inhibiting lock further comprises a spring arranged to bias the hook portion toward the hook receiving portion.

10. A package supporting device as claimed in claim 5, further comprising:

a first member being substantially stationary with respect to the first package support arm, the first member having an aperture; and wherein the movement inhibiting lock comprises a second member movably secured with the second package support arm, the second member being arranged to selectively engage the aperture of the first member.

11. A package supporting device as claimed in claim 10, wherein the lock release device comprises disengagement means for selectively disengaging the second member and the aperture of the first member.

12. A package supporting device as claimed in claim 10, wherein the lock release device comprises:

a movable handle movable in a first direction; and a linkage connecting the movable handle and the second member, the linkage being arranged to transmit movement of the handle in the first direction to movement of the second member away from the aperture of the first member.

13. A package supporting device as claimed in claim 10, wherein the movement inhibiting lock further comprises a spring arranged to bias the second member toward the aperture of the first member.

14. A package supporting device as claimed in claim 5, further comprising a rotation brake arranged to restrain rotation of the package.

15. A package supporting device as claimed in claim 14, wherein the rotation brake is supported by the second package support arm.

16. A package supporting device for rotatably supporting a package in a textile machine, the device comprising:

a first package support arm;

a second package support arm movable toward and away from the first package support arm; and a releasable locking means, disposed on the second package support arm, for selectively restraining movement of the second package support arm away from the first package support arm.

17. A package supporting device as claimed in claim 16, further comprising a rotation brake arranged to restrain rotation of the package.

18. A package supporting device as claimed in claim 17, wherein the rotation brake is supported by the second package support arm.

* * * * *